United States Patent [19]

O'Connor

[11] 4,143,998

[45] Mar. 13, 1979

[54] FLUID PUMP

[75] Inventor: Alton J. O'Connor, Cass City, Mich.

[73] Assignee: Walbro Corporation, Cass City, Mich.

[21] Appl. No.: 767,805

[22] Filed: Feb. 11, 1977

Related U.S. Application Data

[63] Continuation of Ser. No. 583,532, Jun. 4, 1975, abandoned.

[51] Int. Cl.[2] ..... F04B 43/00

[52] U.S. Cl. ..... 417/413; 417/447; 417/451

[58] Field of Search ..... 417/413, 417, 443, 447, 417/571

[56] References Cited

U.S. PATENT DOCUMENTS

| | | | |
|---|---|---|---|
| 1,985,282 | 12/1934 | Carter | 417/571 |
| 2,057,624 | 10/1936 | Burkhart | 417/557 |
| 2,254,084 | 8/1941 | Nelson | 417/443 |
| 2,426,639 | 9/1947 | O'Leary | 417/458 |
| 2,481,183 | 9/1949 | Welby | 417/443 |
| 2,841,092 | 7/1958 | Whitner | 417/458 |
| 3,273,505 | 9/1966 | Miles et al. | 417/413 |
| 3,610,782 | 10/1971 | McGuire | 417/413 |
| 3,811,803 | 5/1974 | Frohberg | 417/458 |

FOREIGN PATENT DOCUMENTS

| | | |
|---|---|---|
| 470354 | 8/1937 | United Kingdom. |
| 1016831 | 5/1962 | United Kingdom. |
| 1085310 | 9/1967 | United Kingdom. |
| 1100945 | 1/1968 | United Kingdom. |
| 1330610 | 9/1973 | United Kingdom. |

*Primary Examiner*—C. J. Husar

*Attorney, Agent, or Firm*—Barnes, Kisselle, Raisch & Choate

[57] ABSTRACT

A fluid pump having a chamber, a diaphragm cooperating with the chamber and actuated by a solenoid, and inlet and outlet check valves communicating with the chamber. Another valve communicating with the chamber and interposed in the flow path of fluid through the pump between the check valves prevents the flow of fluid from the chamber to the exterior of the pump when the diaphragm is not operating while permitting fluid to be admitted to the chamber on an intake stroke of the diaphragm and to be displaced from the chamber on a discharge stroke of the diaphragm when the diaphragm is operating. An adjustable stop permits the length of the intake and discharge strokes of the diaphragm to be adjusted so that the volume of fluid displaced from the pump per each cycle of the diaphragm may be varied and adjusted within predetermined limits.

8 Claims, 2 Drawing Figures

FLUID PUMP

This is a continuation of copending United States patent application Ser. No. 583,532 filed June 4, 1975 and assigned to the assignee hereof now abandoned.

This invention relates to fluid pumps and more particularly to diaphragm pumps of the type used to supply fuel to internal combustion engines, gasoline fired preheaters for the cooling system of internal combustion engines, gasoline fired heaters for the passenger compartment of motor vehicles and the like.

In previously known diaphragm type fuel pumps, the amount of liquid discharged per each cycle of the pump is not adjustable, and pressurized fuel or fuel subject to surges in pressure may flow from the inlet through the outlet of such pumps when they are not operating. Thus, such pumps are unsuitable for supplying fuel to devices requiring a precisely metered rate of flow of fuel. Also, such pumps are unsuitable for supplying fuel from a source of fuel under a pulsating or varying pressure to devices which must not receive any fuel when the pump is not operating. One example of such a pulsating source of fuel is the feed line between the gasoline tank and a conventional fuel pump of an internal combustion engine of a motor vehicle. A catalytic heater for preheating the liquid coolant of an internal combustion engine to facilitate starting of the engine in extremely cold weather such as is described and claimed in United States patent application Ser. No. 493,709 of Nielsen and Charboneau filed July 31, 1974 and entitled Catalytic Heater is an example of a device requiring a pump supplying both a precisely metered rate of flow of fuel and no fuel whatsoever when the pump is not operating.

Objects of the present invention are to provide a pump which may be readily adjusted to provide a precisely metered rate of flow within predetermined limits, through which no fluid can flow when the pump is not operating even though it is connected to a source of fuel under a pulsating or surging pressure, which has a long service life and which is of economical manufacture and assembly, rugged and durable construction, and service and maintenance free.

Figure 1:
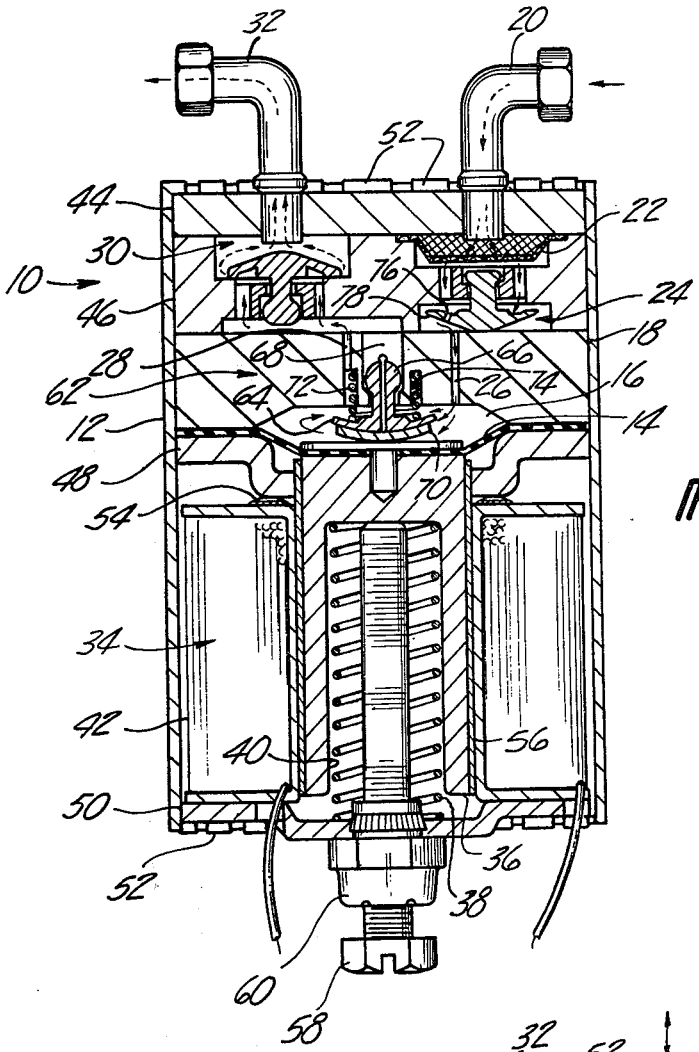
Figure 2:
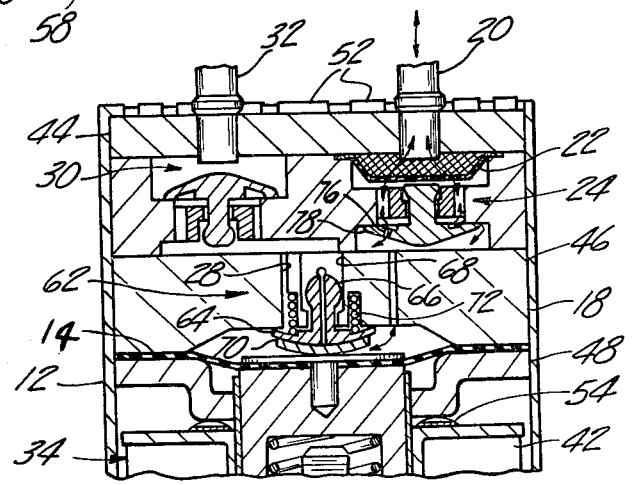

These and other objects, features, and advantages of this invention will be apparent from the following description, appended claims, and accompanying drawings in which:

FIG. 1 is a full sectional view of a pump embodying this invention illustrating the valves thereof in the position they assume during the intake stroke of the pump, and FIG. 2 is a fragmentary sectional view similar to FIG. 1 illustrating the valves of the pump in the position they assume when the pump is not operating.

Referring in more detail to the drawings, FIG. 1 illustrates an electric fuel pump 10 embodying this invention which has a tubular housing 12 with a flexible diaphragm 14 received therein and underlying a pump chamber 16 in a cylindrical carrier plate 18 received in the housing. As indicated by the arrows in FIG. 1, a liquid such as gasoline is admitted to pump chamber 16 through inlet conduit 20, filter screen 22, inlet check valve assembly 24, and passageway 26 through carrier plate 18; and liquid is discharged from the pump chamber through an elongate arcuate passageway 28 in carrier plate 18, outlet check valve assembly 30 and outlet conduit 32. The liquid is moved through pump chamber 16 by the flexing of diaphragm 14 which is actuated by a solenoid 34 with an armature 36 connected to the diaphragm. Armature 36 and hence diaphragm 14 is yieldably biased in one direction by a spring 38 received in a blind hole 40 and is moved in the opposite direction by energization of an electromagnetic coil 42 of solenoid 34.

Inlet 20 and outlet 32 are fixed to a cylindrical top plate 44 and valve assemblies 24 and 30 are carried by a cylindrical valve plate 46. Solenoid coil 42 is received between a cylindrical spacer and retainer plate 48 and a cylindrical bottom plate 50. Inwardly projecting tabs 52 retain top and bottom plates 44 and 50 within housing 12 and a spring washer 54 bearing on the upper end of coil 42 urges the adjacent opposed faces of plates 44, 46 and 48 and diaphragm 14 into sealing engagement with each other. Armature 36 is slideably received in a tubular guide 56 fixed to plate 48 for reciprocation in the guide by coil 42. In accordance with one feature of this invention, the length of the stroke of armature 36 and hence the quantity of fuel delivered on each discharge stroke of pump 10 is controlled and may be precisely metered within predetermined limits by adjustment of a threaded stop screw 58 received in a nut 60 fixed to bottom plate 50.

In accordance with another feature of this invention, a pressurized liquid at inlet 20 such as gasoline is prevented from flowing through pump 10 when solenoid coil 42 is de-energized by a valve assembly 62 mounted on plate 18 and shown in FIG. 2 in the closed position it assumes when coil 42 is de-energized. Valve assembly 62 has a valve member 64 with a bulbous stem 66 received for reciprocation in a counterbore 68 in carrier plate 18 to open and close (as shown in FIGS. 1 & 2) fuel outlet passage 28. Valve member 64 has a metallic wear cap 70 on the lower surface thereof and is yieldably biased by a spring 72 received in an annular pocket 74 into engagement with diaphragm 14 and armature 36 for reciprocation therewith.

To prevent pump 10 from becoming inoperative due to pressure surges or pulses in the liquid supplied to inlet conduit 20 simultaneously forcing armature 36 downward into engagement with stop 58 and forcing valves 24 and 62 closed, a small bleed passage 76 is provided in valve member 78 of inlet valve assembly 24 so that pump chamber 14 communicates with inlet 20 when valve 24 is closed. The efficiency and capacity of pump 10 is not materially decreased by bleed passage 76 (not shown to scale in the drawings) since it provides a relatively small passage compared to outlet passage 28.

In operation of pump 10 energization of coil 42 moves armature 36 downward against the bias of spring 38 to bear on stop screw 58 as shown in FIG. 1, thereby opening valve 62 and moving diaphragm 14 downward in an intake stroke to pull liquid into pump chamber 14 through inlet conduit 20, screen 22, inlet valve 24, and passageway 26. When coil 42 is de-energized, spring 38 moves armature 36 upward to the position shown in FIG. 2, thereby moving diaphragm 14 upward in a discharge stroke to displace fuel from pump chamber 16 through passageway 28, outlet valve 30, and outlet conduit 32; and, upon completion of the discharge stroke of diaphragm 14, closes valve 62 against the bias of spring 72. Thus, valve 62 remains closed so long as coil 42 is de-energized, thereby preventing liquid from being forced through chamber 16 and outlet 32 of pump 10 by pressure surges or pulses in the line to which inlet conduit 20 is connected. Without bleed passage 76 in inlet valve 24 these pressure surges could force liquid past inlet valve 24 and into chamber 14 when coil 42 is de-energized which pressurized liquid could simultaneously force armature 36 downward into engagement with stop screw 58 and close valves 62 and 24 thereby entrapping the pressurized liquid in chamber 16 which would render pump 10 permanently inoperative. However, bleed passage 76 prevents this from occurring by permitting such pressurized liquid in chamber 16 to bleed back into inlet 20 when the pressure surge at inlet 20 subsides.

I claim:

1. A pump for liquids having a pump chamber, inlet and outlet check valves, inlet and outlet passages communicating with said pump chamber through said inlet and outlet check valves respectively, a diaphragm cooperating with said pump chamber and said check valves to admit liquid through said inlet passage into said chamber on an intake stroke of said diaphragm and to discharge liquid from said chamber through said outlet passage on a discharge stroke of said diaphragm, a solenoid having an electromagnetic coil and an armature connected to said diaphragm and received within said electromagnetic coil to alternately impart intake and discharge strokes to said diaphragm in response to alternately energizing and de-energizing said electromagnetic coil, a valve seat in a wall of said pump chamber and interposed in the flow path of liquid through said pump between said check valves, a valve within said pump chamber and constructed and arranged such that when intake and discharge strokes are imparted to said diaphragm by said armature and electromagnetic coil said valve is yieldably biased to normally move in unison with said diaphragm and be reciprocated with respect to said seat to permit liquid in said pump chamber to be discharged from said chamber on a discharge stroke of said diaphragm and when said diaphragm is not being operated by said armature and electromagnetic coil said valve engages said seat to prevent the flow of liquid from said chamber through said outlet passage to the exterior of said pump even when said diaphragm is displaced from said valve by liquid admitted to said chamber through said inlet valve, and means yieldably biasing said diaphragm toward the completion of its discharge stroke when said electromagnetic coil is de-energized.

2. The pump of claim 1 which also comprises a bleed passage communicating said pump chamber with said inlet passage upstream of said inlet check valve at least when said inlet check valve is closed and said pump is not operating.

3. The pump of claim 1 which also comprises a bleed passage located in said inlet check valve and continuously communicating said pump chamber with said inlet passage upstream of said inlet check valve.

4. The pump of claim 1 which also comprises an adjustable stop constructed and arranged to extend into said armature and to engage within a predetermined range of positions said armature to limit within such predetermined range the length of the intake stroke imparted to said diaphragm by said solenoid such that the volume of liquid discharged by said pump per each cycle of said diaphragm can be varied and adjusted within predetermined limits.

5. The pump of claim 4 which also comprises a bleed passage located in said inlet check valve and continuously communicating said pump chamber with said inlet passage upstream of said inlet check valve.

6. The pump of claim 1 wherein the force produced by said means yieldably urging said diaphragm toward the completion of its discharge stroke is sufficiently greater than the force produced by said means yieldably biasing said valve away from said seat such that a surge of pressurized liquid entering said chamber through said inlet valve when said pump is not operating will not disengage said valve from said valve seat even if said diaphragm is moved away from said valve against the bias of said means urging said armature and diaphragm toward completion of said discharge stroke of said diaphragm.

7. The pump of claim 6 which also comprises an adjustable stop constructed and arranged to extend into said armature and to engage within a predetermined range of positions said armature to limit within such predetermined range the length of the intake stroke imparted to said diaphragm by said solenoid such that the volume of liquid discharged by said pump per each cycle of said diaphragm can be varied and adjusted within predetermined limits.

8. The pump of claim 6 which also comprises a bleed passage located in said inlet check valve and continuously communicating said pump chamber with said inlet passage upstream of said inlet check valve.

* * * * *